US009631906B2

(12) United States Patent
English et al.

(10) Patent No.: US 9,631,906 B2
(45) Date of Patent: Apr. 25, 2017

(54) ELECTRONICALLY SCORED TARGET ARRAY

(71) Applicants: Capel Calhoun English, Alpharetta, LA (US); Pierce Otis English, Marietta, GA (US)

(72) Inventors: Capel Calhoun English, Alpharetta, LA (US); Pierce Otis English, Marietta, GA (US)

( * ) Notice: Subject to any disclaimer, the term of this patent is extended or adjusted under 35 U.S.C. 154(b) by 0 days.

(21) Appl. No.: 15/075,395

(22) Filed: Mar. 21, 2016

(65) Prior Publication Data

US 2016/0273888 A1 Sep. 22, 2016

Related U.S. Application Data

(60) Provisional application No. 62/135,869, filed on Mar. 20, 2015.

(51) Int. Cl.
*F41J 5/00* (2006.01)
*F41J 5/052* (2006.01)
*F41J 5/06* (2006.01)

(52) U.S. Cl.
CPC . *F41J 5/052* (2013.01); *F41J 5/06* (2013.01)

(58) Field of Classification Search
CPC . F41J 7/04; F41J 1/10; F41J 7/00; F41J 6/14; F41J 5/056; F41J 5/06
USPC ..... 273/407, 406, 390–392, 371, 372, 374, 273/376
See application file for complete search history.

(56) References Cited

U.S. PATENT DOCUMENTS 1,348,442 A * 8/1920 Prebble ..... F41J 7/04 273/390
1,733,606 A * 10/1929 Junker ..... A63F 9/02 273/371
2,691,526 A * 10/1954 Wesley ..... A63F 9/0204 273/359
4,222,564 A 9/1980 Allen et al.
4,524,976 A * 6/1985 Seitz ..... F41J 7/04 273/388
4,611,993 A * 9/1986 Brown ..... F41J 9/14 273/371
5,342,062 A * 8/1994 Lance ..... F41J 7/04 273/391

(Continued)

*Primary Examiner* — Mark Graham
(74) *Attorney, Agent, or Firm* — Asgaard Patent Services, LLC; F. Wayne Thompson, Jr.

(57) ABSTRACT

Implementations of an electronically scored target array are provided. In some implementations, the electronically scored target array may be used for training individuals in the use of rifles, hand guns, and similar weapons. In some implementations, the electronically scored target array may be used to facilitate competition between participating individuals. In some implementations, the electronically scored target array may be configured to record the performance (e.g., the number of target plates shot, number of target plates not shot (e.g., missed), overall time, etc.) of a shooter during a course of fire. In some implementations, the electronically scored target array comprises a base, a base guard, a cover plate, a first trunk tube, a second trunk tube, and nine target plates. In some implementations, the electronically scored target array may further comprise gaming software, a target controller, nine lasers mounted to the base, and an accelerometer secured to each target plate.

19 Claims, 10 Drawing Sheets

(56) References Cited

U.S. PATENT DOCUMENTS

| | | | | |
|---|---|---|---|---|
| 6,322,365 | B1 | 11/2001 | Shechter et al. | |
| 6,779,797 | B1 * | 8/2004 | Chou | F41J 7/04 273/391 |
| 6,991,233 | B2 * | 1/2006 | Goldsmith, Jr. | F41J 7/04 273/392 |
| 8,608,169 | B2 * | 12/2013 | Saunders | F41J 7/04 273/392 |
| 2002/0158413 | A1 * | 10/2002 | Dehart | F41J 7/00 273/390 |
| 2005/0098954 | A1 * | 5/2005 | Stutz | F41J 7/04 273/390 |
| 2010/0032905 | A1 * | 2/2010 | Morrow | F41J 1/10 273/366 |
| 2011/0175293 | A1 * | 7/2011 | Brune | F41J 7/04 273/406 |
| 2013/0049299 | A1 * | 2/2013 | Guthrie | A63B 24/0021 273/358 |
| 2014/0232067 | A1 * | 8/2014 | Barry | F41J 1/10 273/392 |
| 2015/0069707 | A1 * | 3/2015 | Dunlop | A63B 63/00 273/390 |
| 2015/0123346 | A1 * | 5/2015 | Mason | F41J 1/10 273/371 |
| 2015/0268013 | A1 * | 9/2015 | Heise | F41J 7/04 273/389 |
| 2015/0276356 | A1 * | 10/2015 | Cesternino | F41J 9/02 273/370 |
| 2015/0369572 | A1 * | 12/2015 | Smolka | F41J 5/14 273/371 |
| 2016/0091285 | A1 * | 3/2016 | Mason | F41J 5/04 273/372 |

* cited by examiner

ELECTRONICALLY SCORED TARGET ARRAY

CROSS REFERENCE TO RELATED APPLICATION

This application claims the benefit of U.S. Patent Application Ser. No. 62/135,869, which was filed on Mar. 20, 2015, and is incorporated herein by reference in its entirety.

TECHNICAL FIELD

This disclosure relates to implementations of an electronically scored target array.

BACKGROUND

Competitive shooting sports today include firing handguns, rifles, and other firearms at various types of targets (e.g., steel, paper, etc.). Performance is a measure of accuracy, speed, time, shot placement, shot grouping, and a host of combinations of these and other criteria. To successfully compete, a shooter must possess a combination of skills, competitive talents, and equipment (e.g., firearm and ammunition). The required skills involve marksmanship fundamentals, such as stance, grip, sight picture, sight alignment, breathing control, trigger manipulation, and follow through. Competitive talents necessary to compete vary by discipline, but may include shooting while moving, drawing from the holster, transitioning efficiently between targets, etc.

A variety of target systems are available for shooters to develop their marksmanship skills and facilitate competition between participants. User preference, competitive considerations, and the size of a firing range often direct the target or target system selected for use.

SUMMARY OF THE INVENTION

Implementations of an electronically scored target array are provided. In some implementations, the electronically scored target array comprises a base, a base guard, a cover plate, a first trunk tube, a second trunk tube, and nine target plates. In some implementations, the electronically scored target array may further comprise a target controller, nine lasers, and nine accelerometers.

In some implementations, the base of the electronically scored target array may be configured to support the trunk tubes. In some implementations, the trunk tubes may be at a 65 degree angle relative to the base.

In some implementations, a first strike plate and a second strike plate may be secured to the front side of the first trunk tube and the second trunk tube, respectively. In some implementations, the strike plates may be configured to protect the trunk tubes and/or other portions of the electronically scored target array located behind the target plates from damage.

In some implementations, a first spall plate and a second spall plate may be secured on opposite sides of the electronically scored target array. In some implementations, each spall plate may be secured to one or more of the plate cross bars used to secure target plates to the trunk tubes of the electronically scored target array. In some implementations, the spall plates may be configured to prevent ricocheting projectiles and/or spall from striking objects or structures located on either side of the electronically scored target array. In this way, for example, the electronically scored target array may be used at an indoor firing range without damaging the interior walls.

In some implementations, the cover plate may be configured to fit onto the top of the base. In some implementations, the cover plate may be configured to cover one or more interior compartments of the base. In this way, any electronics (e.g., the target controller), wiring, and/or other equipment stored within the interior compartment(s) may be protected from spall resulting from projectiles impacting on and/or around the target plates and/or strike plates.

In some implementations, the electronically scored target array may include a first target plate assembly, a second target plate assembly, and a third target plate assembly. In some implementations, the electronically scored target array may include more than three or less than three target plate assemblies.

In some implementations, each target plate assembly may comprise three target plates secured to a plate cross bar, three isolation blocks, two isolation bars, and six dampener blocks. The target plates of each target plate assembly are spaced to not come into contact with each other. In some implementations, the target plates when secured to a target plate assembly may be at a 70 degree angle relative to the base.

In some implementations, the angle (e.g., 70 degrees) of the target plates relative to the base may be different than the angle (e.g., 65 degrees) of the trunk tubes relative to the base. In this way, spall resulting from a projectile impacting on one target plate will not be deflected downwardly along a path that would cause it to strike a target plate positioned below it.

In some implementations, the isolation blocks, isolation bars, and dampener blocks of each target plate assembly may be made of an isolation material. In some implementations, the isolation blocks, isolation bars, and dampener blocks may be positioned and used to shock isolate each target plate from the plate cross bar and/or to shock isolate the plate cross bar from each trunk tube. In this way, when a projectile strikes any portion of the electronically scored target array the resulting forces (i.e., vibrations) are not transferred to a target plate that was not directly struck by the projectile. This prevents the accelerometer on the back side of each target plate from registering a hit when there was none.

In some implementations, the nine lasers may be secured to the base of the electronically scored target array. In some implementations, there may be one laser for each target plate on the electronically scored target array. In some implementations, each laser is positioned so that a laser beam generated thereby illuminates a single target plate.

In some implementations, a target controller in conjunction with a computer (e.g., a laptop, desktop, tablet, and/or other portable electronic device) may be used to control the operation of the lasers and/or the accelerometers of the electronically scored target array.

In some implementations, when an accelerometer on a target plate registers the impact of a projectile on that target plate, a signal is passed to the target controller. In some implementations, the target controller may be configured to control when, for how long, and/or which accelerometer(s) are activated. In this way, only hits on a target plate with an activated accelerometer are recorded.

In some implementations, a laser(s) may be used to designate the target plate(s) having an active accelerometer. A signal may be passed from the target controller to the laser(s) and thereby control when, for how long, and/or which laser(s) are activated. In this way, a user may know which target plates to engage (i.e., to shoot) for score.

In some implementations, gaming software may be used in conjunction with a computer and one or more target controllers. In some implementations, the gaming software may be used to control the activation of the lasers and/or accelerometers of an electronically scored target array. In some implementations, the gaming software may be used to create a preset course of fire that will control the activation of the lasers and/or accelerometers. In some implementations, a course of fire may be randomly generated by the gaming software.

In some implementations, the gaming software may be used to associate recorded times, the number of target plates shot, the number of target plates not shot (i.e., missed or not engaged), and/or any other recorded information with a particular shooter. In some implementations, the recorded times, successful hits on the target plates, the number of target plates not hit, and/or any other recorded information (e.g., personal information about the shooter) may be stored by the gaming software and associated with an account of the shooter's.

DETAILED DESCRIPTION

Figure 1A:
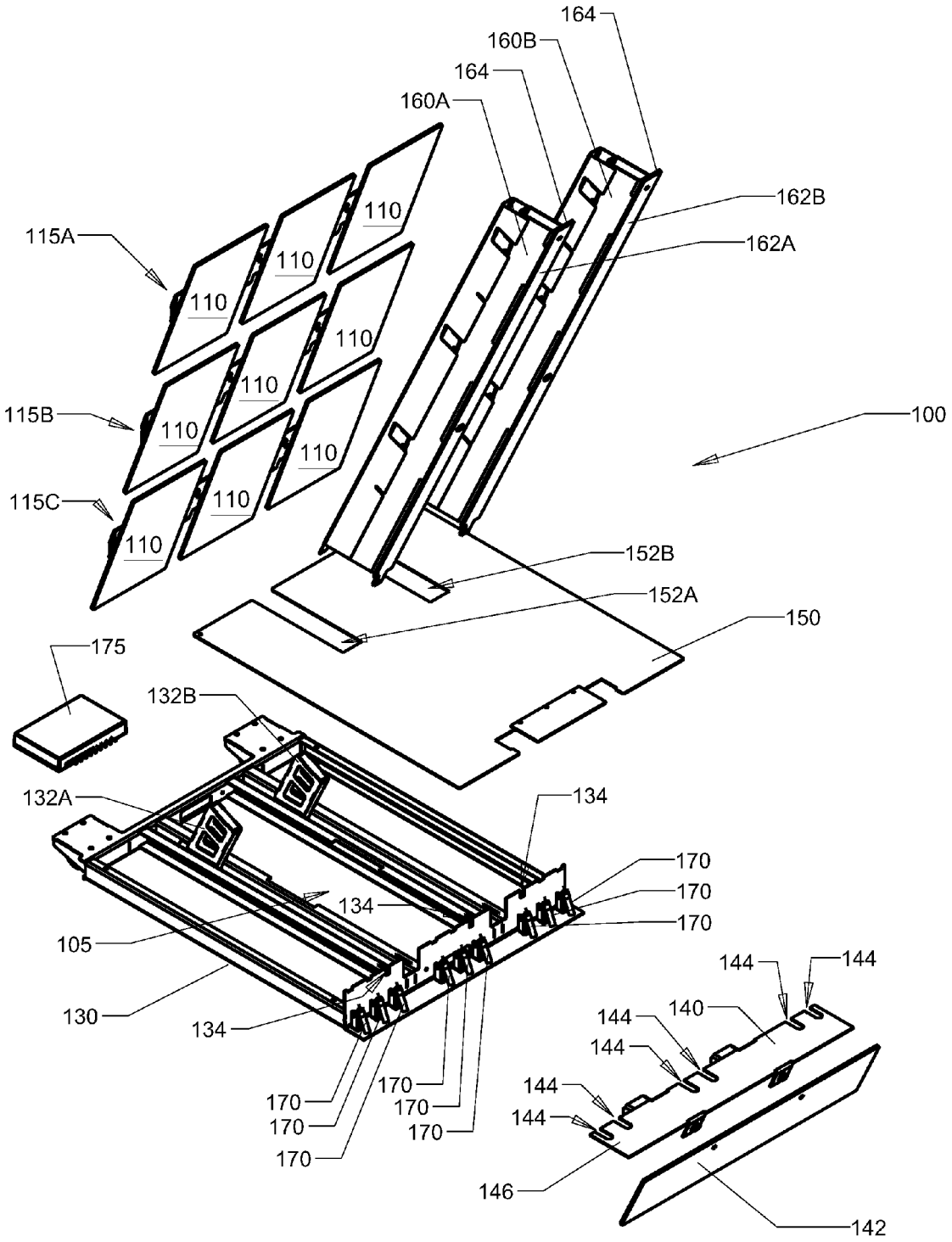
FIGS. 1A-1D illustrate an example implementation of the electronically scored target array according to the principles of the present disclosure.

FIGS. 1A-1D illustrate an example electronically scored target array 100 according to the principles of the present disclosure. In some implementations, the electronically scored target array 100 may be used for training individuals in the use of rifles, hand guns, and similar weapons. In some implementations, the electronically scored target array 100 may be configured to record the performance (e.g., the number of target plates hit, number of target plates not hit (e.g., missed or not engaged), overall time, etc.) of a shooter during a course of fire. In some implementations, the electronically scored target array 100 may be used to facilitate competition between participating individuals.

As shown in FIGS. 1A-1D, in some implementations, the electronically scored target array 100 may comprise a base 130, a base guard 140, a cover plate 150, a first trunk tube 160A, a second trunk tube 160B (collectively trunk tubes 160), and nine target plates 110. In some implementations, the electronically scored target array 100 may further comprise a target controller 175, nine lasers 170, and nine accelerometers 173 (see, e.g., FIGS. 1A and 4B). In some implementations, the electronically scored target array 100 further comprises a first spall plate 190A and a second spall plate 190B.

Figure 1B:
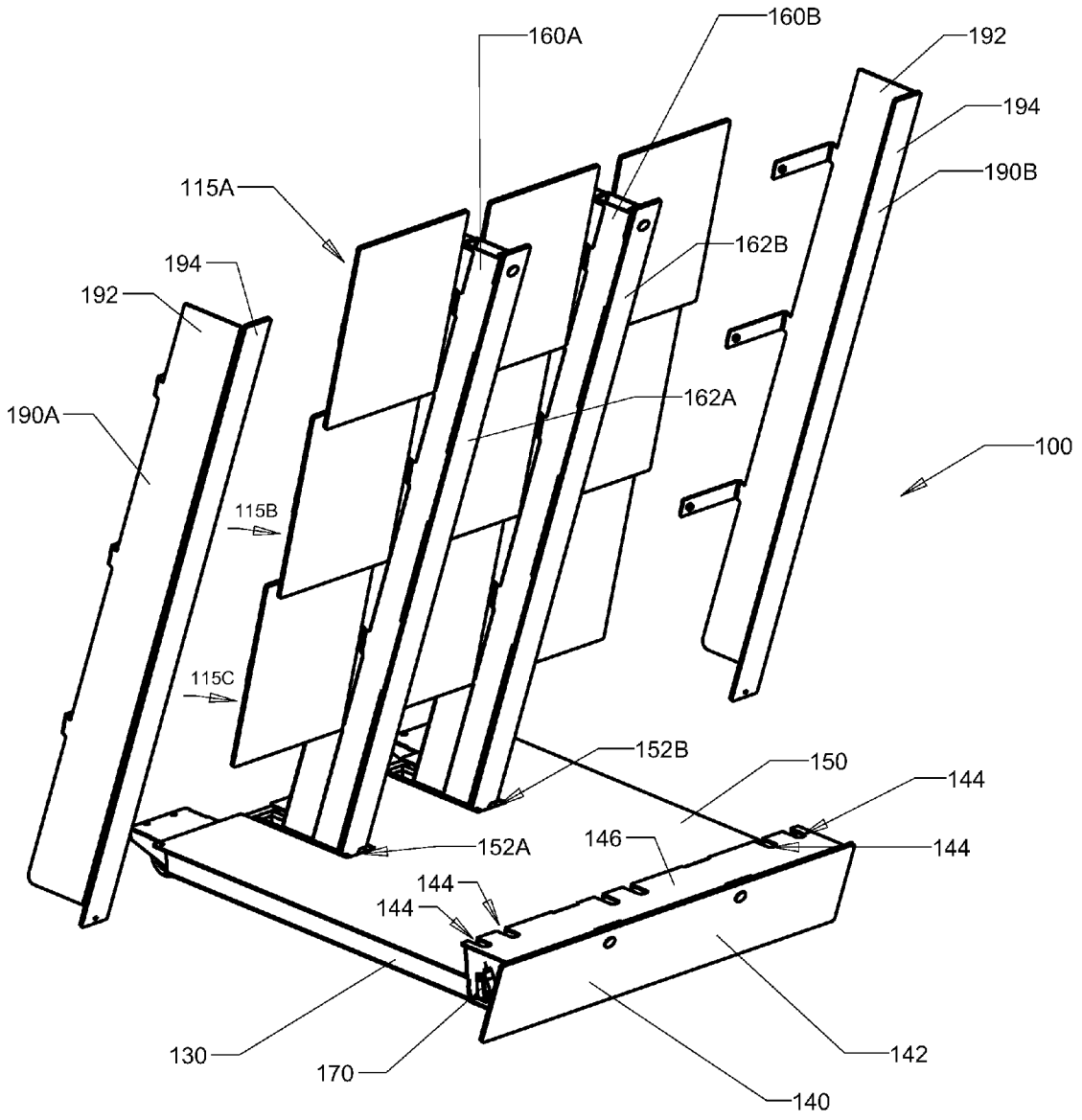

As shown in FIGS. 1A and 1B, in some implementations, the base 130 of the electronically scored target array 100 may be configured to support the trunk tubes 160. In some implementations, the base 130 may include a first protrusion 132A and a second protrusion 132B (collectively protrusions 132) configured to receive thereon and/or support the first trunk tube 160A and the second trunk tube 160B, respectively (see, e.g., FIG. 1C). In some implementations, the protrusions 132 are configured to be received within an opening located on at least one end of each trunk tube 160. In some implementations, the protrusions 132 may be at a 65 degree angle relative to the base 130 (see, e.g., FIG. 1A). In this way, the trunk tubes 160, when secured to the protrusions 132, are at a 65 degree angle relative to the base 100 (see, e.g., FIG. 1B). In some implementations, the angle of the protrusions 132 relative to the base may be greater than, or less than, 65 degrees.

Figure 1C:
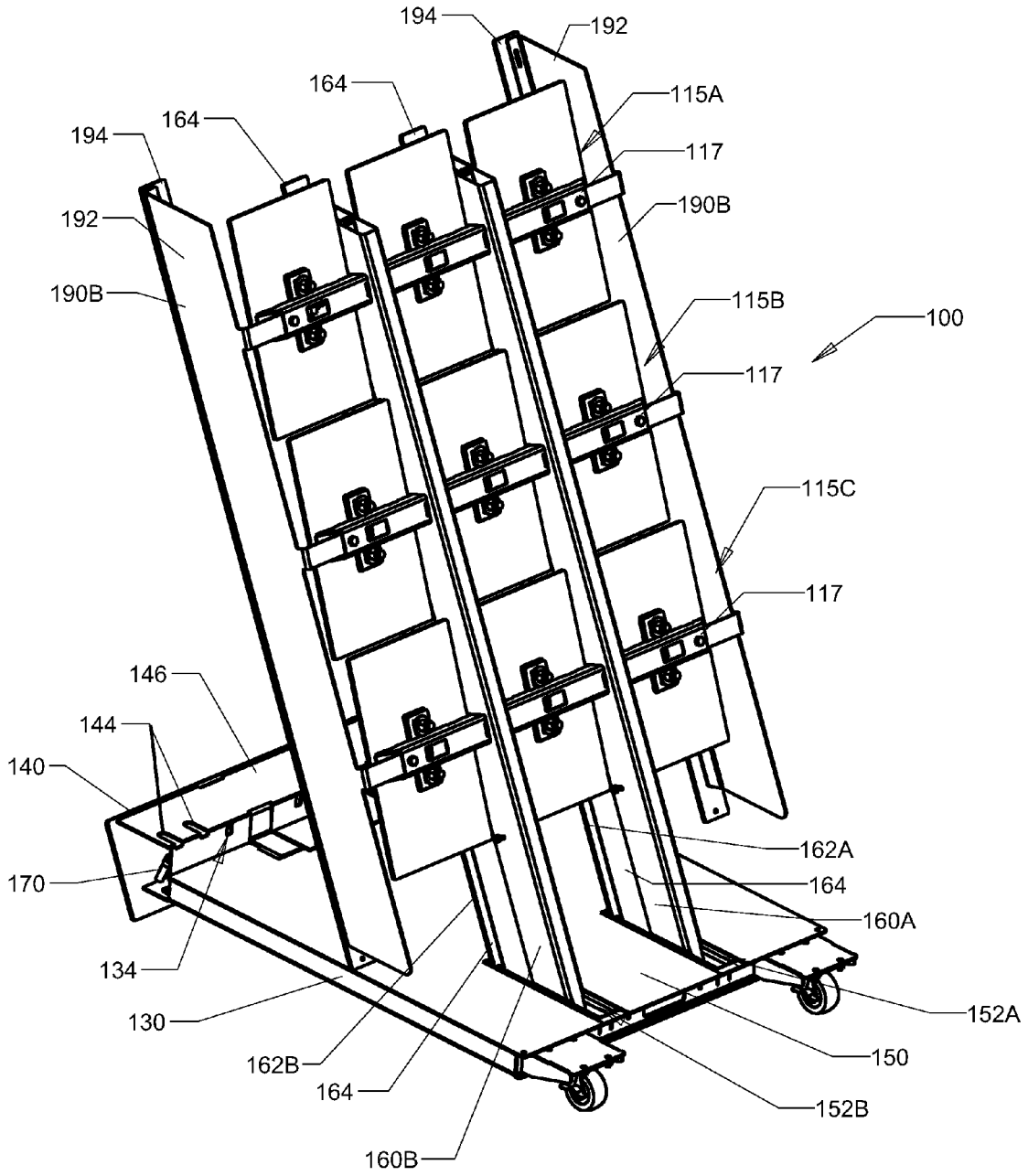

As shown in FIG. 1C, in some implementations, the trunk tubes 160 may have the profile of a rectangle. In some implementations, the trunk tubes 160 may be hollow. In some implementations, the trunk tubes 160 may be a solid piece of material except for an interior opening on at least one end configured to receive a protrusion 132 extending from the base 130.

As shown in FIG. 1B, in some implementations, a first strike plate 162A and a second strike plate 162B (collectively strike plates 162) may be secured to the first trunk tube 160A and the second trunk tube 160B, respectively. In some implementations, the strike plates 162 may be configured to protect the trunk tubes 160 from impacting projectiles (i.e. bullets). In some implementations, each strike plate 162 may be a single piece of material (see, e.g., FIG. 1B). In some implementations, each strike plate 162 may be comprised of multiple pieces of material.

Figure 1D:
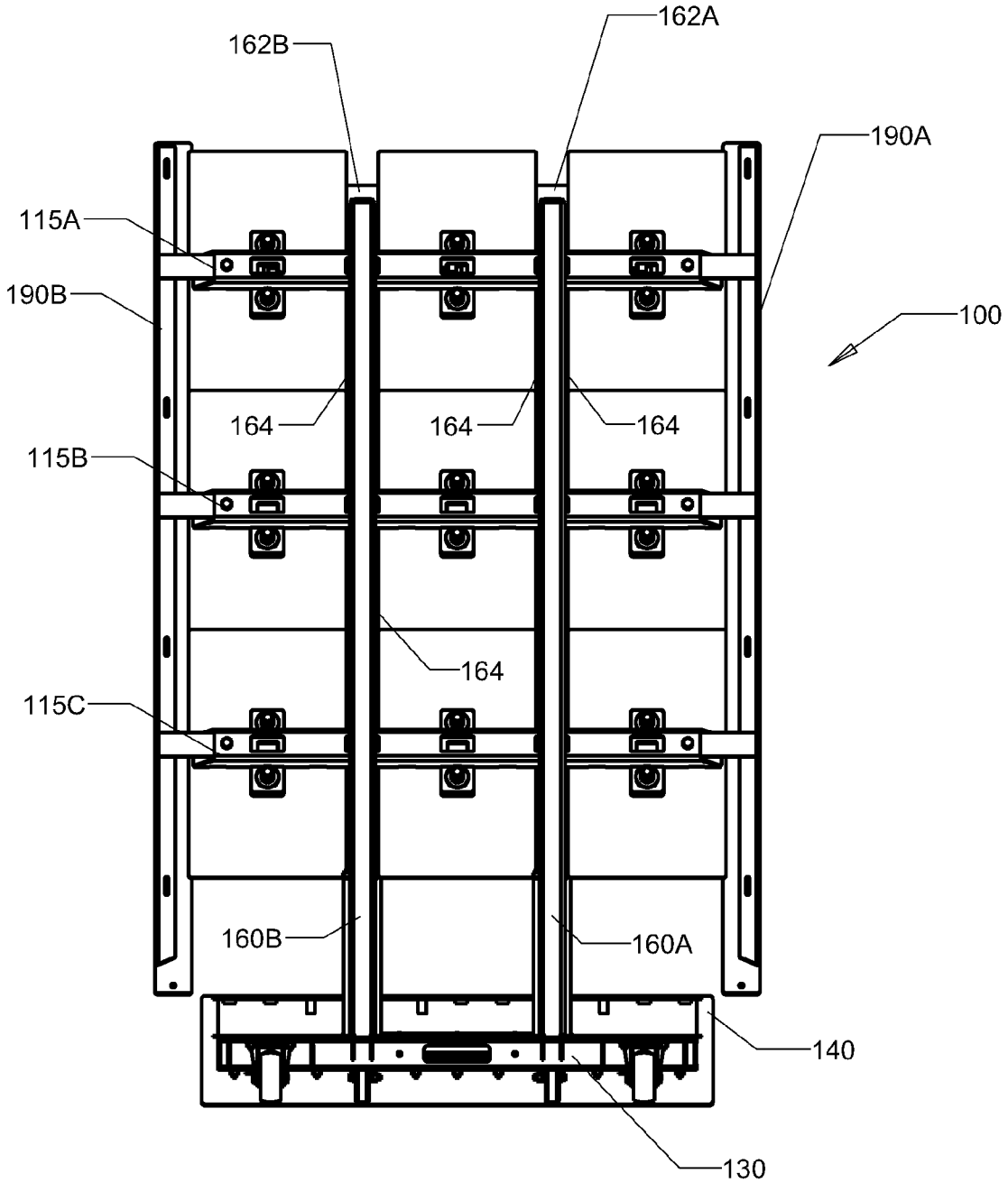

As shown in FIGS. 1C and 1D, in some implementations, the strike plates 162 may be wider than a front side of a trunk tube 160A, 160B thereby creating a lip 164. In some implementations, the lip 164 extending from each side of a strike plate 162 may overhang a portion of each target plate 110 positioned adjacent thereto (see, e.g., FIG. 1D). In this way, when a projectile impacts a target plate 110 positioned adjacent a trunk tube 160A, 160B any resulting spall that strikes a side of a trunk tube may be prevented from flying back at the shooter. In some implementations, the lip 164 may prevent a projectile from striking the gap between a trunk tube 160 and any of the plates positioned adjacent thereto (see, e.g., FIG. 1D). In this way, each lip 164 may protect portions (e.g., the plate cross bars 117) of the electronically scored target array 100 located behind the target plates 110 from damage. In some implementations, a strike plate 162 may only be as wide as the front side of a trunk tube 160.

As shown in FIGS. 1C and 1D, in some implementations, a first spall plate 190A and a second spall plate 190B (collectively spall plates 190) may be secured on opposite sides of the electronically scored target array 100. In some implementations, each spall plate 190A, 190B may be secured to one or more of the plate cross bars 117 (see, e.g., FIG. 1C). In some implementations, the spall plates 190 may be configured to prevent ricocheting projectiles and/or spall (resulting from a projectile impacting a target plate 110) from striking objects located on either side of the electronically scored target array 100. In this way, for example, the electronically scored target array 100 may be used at an indoor firing range without damaging the interior walls.

In some implementations, as shown in FIG. 1B, each spall plate 190A, 190B may comprise a first side wall 192 and a second side wall 194. In some implementations, each spall plate 190 may have an "L" shaped profile when viewed from the side. In some implementations, each spall plate 190A, 190B may be a single piece of material. In some implementations, the second side wall 194 of each spall plate 190 may be at a perpendicular angle relative to the first side wall 190 (see, e.g., FIG. 1B). In some implementations, the second side wall 194 may overhang a portion of each target plate 110 positioned adjacent thereto. In this way, when a projectile impacts on a target plate 110 positioned adjacent a spall plate 190A, 190B, any resulting spall that strikes the interior side of a first side wall 192 may be prevented from flying back at the shooter and/or striking a wall positioned to the side of the electronically scored target array 100.

As shown in FIG. 1B, the cover plate 150 may be configured to fit onto the top of the base 130. In some implementations, the cover plate 150 may be configured to cover one or more interior compartments 105 of the base 130 (see, e.g., FIGS. 1A and 1B). In this way, any electronics (e.g., the target controller 175), wiring, and/or other equipment stored within the interior compartment(s) 105 may be protected from spall resulting from projectiles impacting on and/or around the target plates 110 and/or strike plates 162. In some implementations, the cover plate 150 may protect the base 130 from spall resulting from projectiles impacting on and/or around the target plates 110 and/or strike plates 162.

As shown in FIG. 1A, in some implementations, the cover plate 150 may have a first cutout 152A and a second cutout 152B therein (collectively cutouts 152). In some implementations, the first cutout 152A and the second cutout 152B may be configured to fit about a portion of the first trunk tube 160A and the second trunk tube 160B, respectively (see, e.g., FIG. 1B). In some implementations, the cutouts 152 may be any shape suitable for fitting about the trunk tubes 160.

As shown in FIG. 1B, in some implementations, a front side of the base 130 may be protected by a base guard 140. In this way, the base 130 and the interior compartment(s) 105 thereof may be protected from impacting projectiles and/or spall. In some implementations, the base guard 140 may be removably secured to the base 130. In some implementations, the base guard 140 may be fixedly secured to the base 130. In some implementations, the base guard may include a strike face 142 on a front side thereof (see, e.g., FIG. 1A). In some implementations, the strike face 142 may be angled down. In this way, an incoming projectile may be deflected away from the base 130. In some implementations, the strike face may have an angle of between 60 and 65 degrees, inclusive of 60 and 65, relative to the base 130. In some implementations, the strike face 142 may have an angle greater than 65 degrees or less than 60 degrees.

As shown in FIGS. 1A-1D, in some implementations, the electronically scored target array 100 may include a first target plate assembly 115A, a second target plate assembly 115B, and a third target plate assembly 115C (collectively target plate assemblies 115). In some implementations, the electronically scored target array 100 may include more than three or less than three target plate assemblies 115.

Figure 2A:
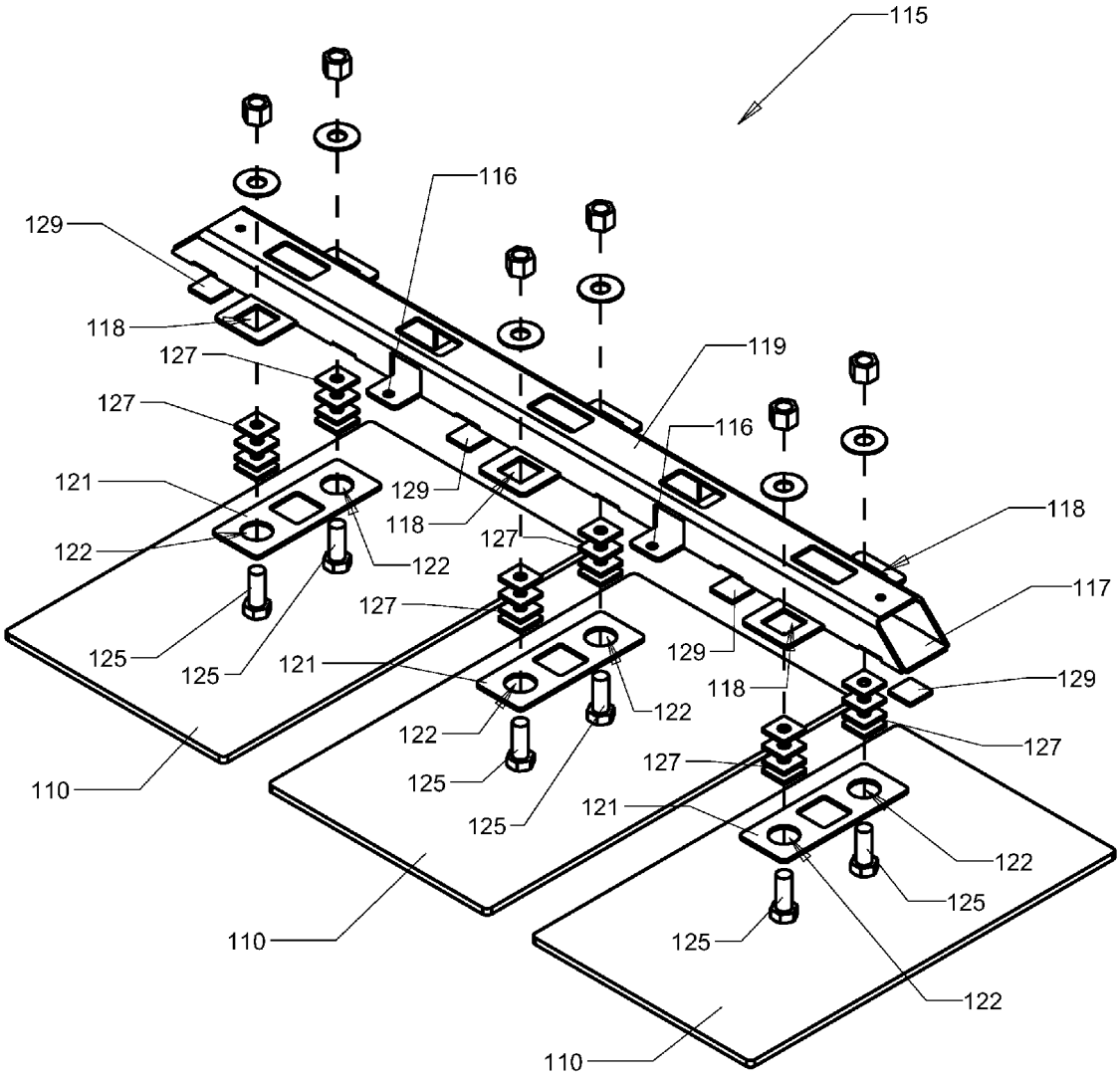
FIG. 2A illustrates an exploded view of a target plate assembly according to the principles of the present disclosure.
Figure 2B:
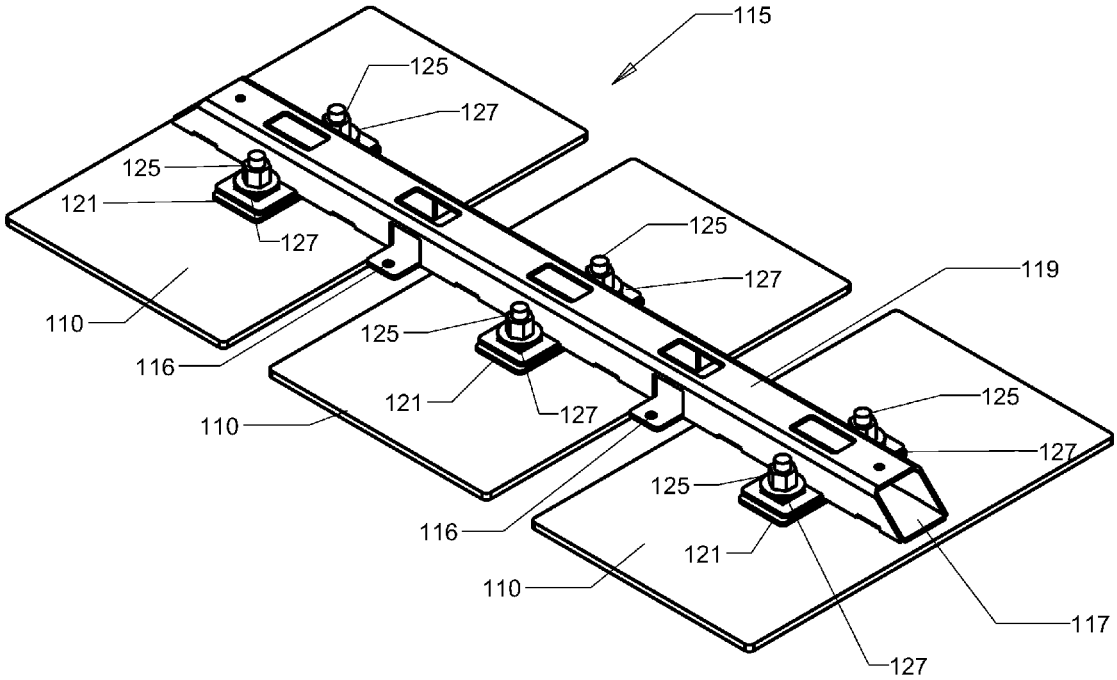
FIG. 2B illustrates a rear view of an assembled target plate assembly according to the principles of the present disclosure.

In some implementations, as shown in FIGS. 2A-2B, a target plate assembly 115 may comprise three target plates 110, a plate cross bar 117, a plate cross bar cap 119, three isolation blocks 121, two isolation bars 123, and six dampener blocks 127. In some implementations, a target plate assembly 115 may include more than three target plates 110 or less than three target plates 110.

As shown in FIG. 2B, the target plates 110 of each target plate assembly 115 are spaced to not come into contact with each other. In some implementations, the strike face or front side of the target plates 110 when secured to a target plate assembly 115 may be at a 70 degree angle relative to the base 130 (see, e.g., FIG. 1B). In this way, a projectile striking a target plate 110 may be prevented from ricocheting back towards the shooter and/or spectators. In some implementations, the angle of the target plates relative to the base 130 may be greater than, or less than, 70 degrees.

As shown in FIG. 1B, in some implementations, the angle (e.g., 70 degrees) of the target plates 110 relative to the base 130 may be different than the angle (e.g., 65 degrees) of the trunk tubes 160 relative to the base 130. In this way, spall resulting from a projectile impacting on a target plate 110 of the first and/or second target plate assemblies 115A, 115B will not be deflected downwardly along a path that would cause it to strike a target plate 110 secured to another target plate assembly 115. This will prevent the impact of a projectile on one target plate 110 from being scored as a hit on another target plate 110.

In some implementations, as shown in FIG. 2A, each target plate 110 may have two screws 125 protruding from a backside thereof. In some implementations, each target plate 110 may be shaped like a rectangle (see, e.g., FIG. 2B). In some implementations, each target plate 110 may be shaped like a square, a circle, a silhouette, and/or any other shape suitable for shooting a firearm at.

Figure 3A:
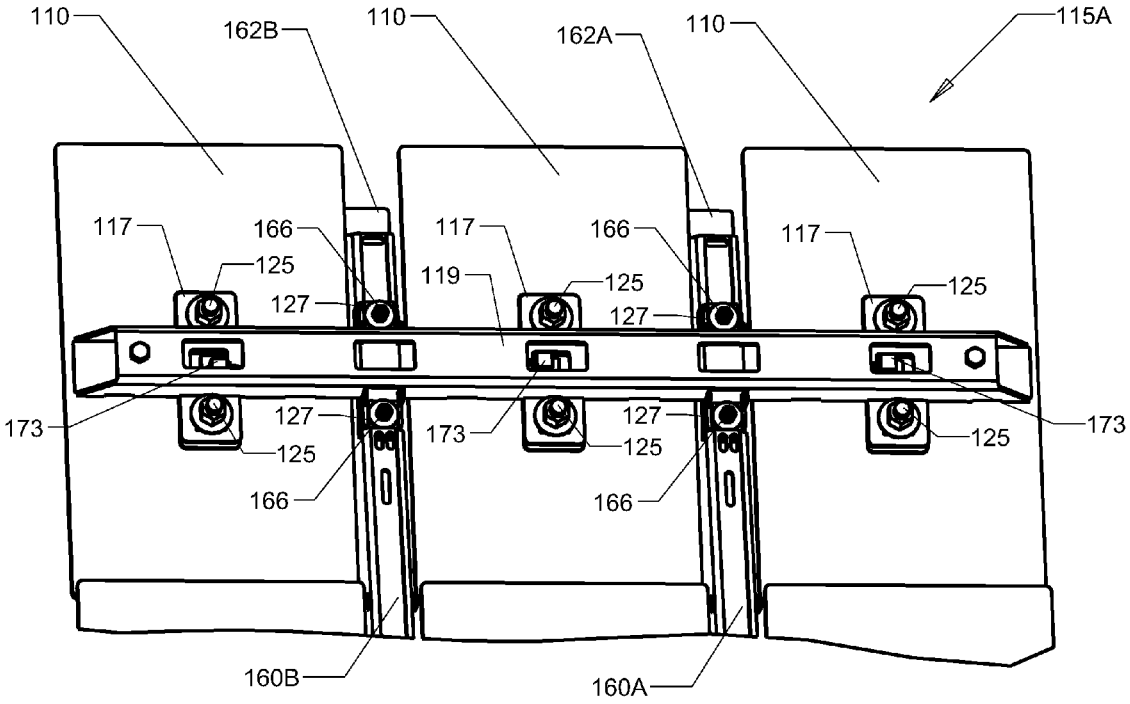
FIGS. 3A and 3B illustrate a close up view of a target plate assembly of the electronically scored target array shown in FIGS. 1C and 1D.
Figure 3B:
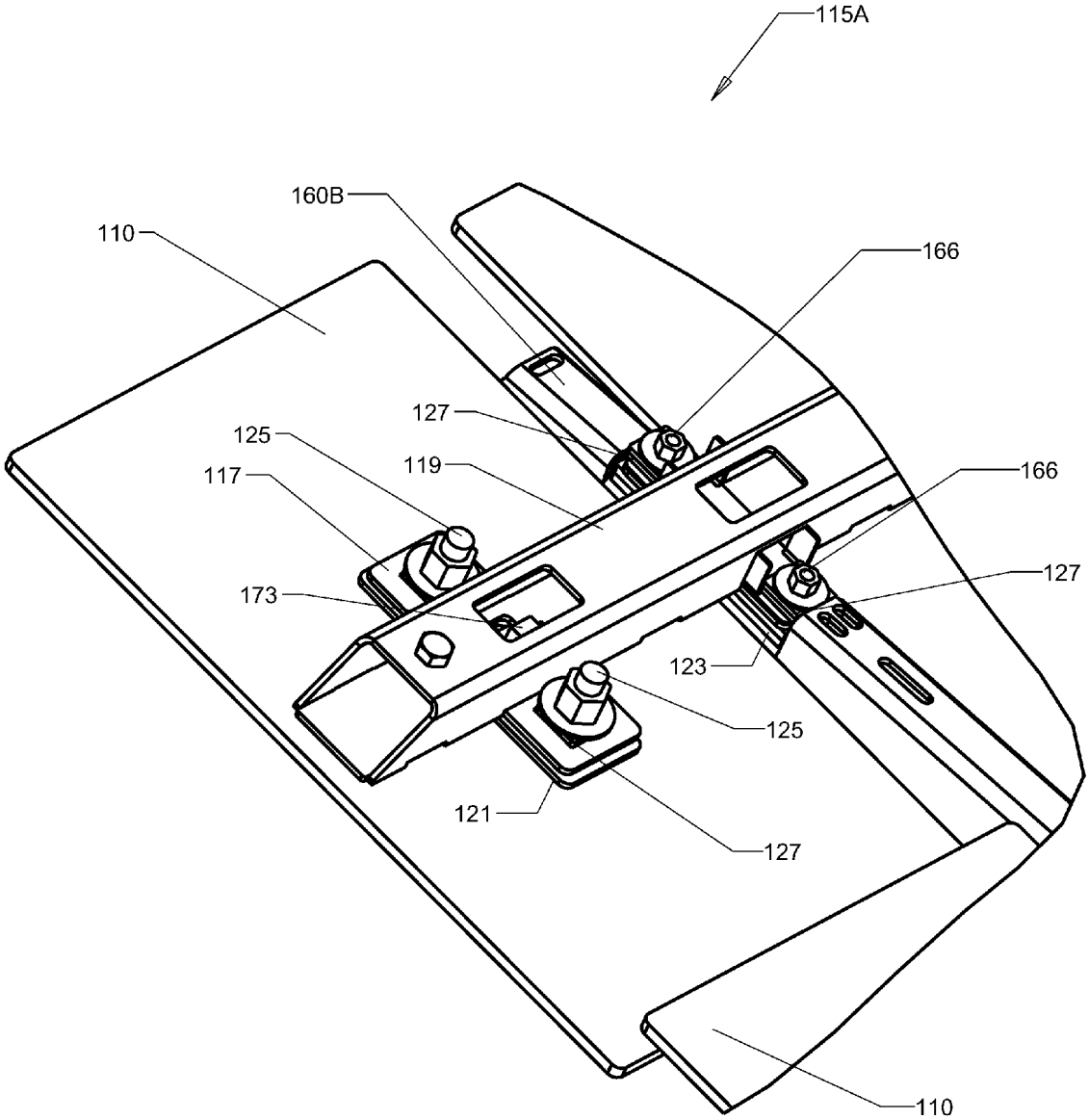

In some implementations, an isolation block 121 and/or an isolation bar 123 may be a single piece of material (see, e.g., FIG. 3B). In some implementations, an isolation block 121 and/or an isolation bar 123 may be two or more pieces of material.

Figure 2C:
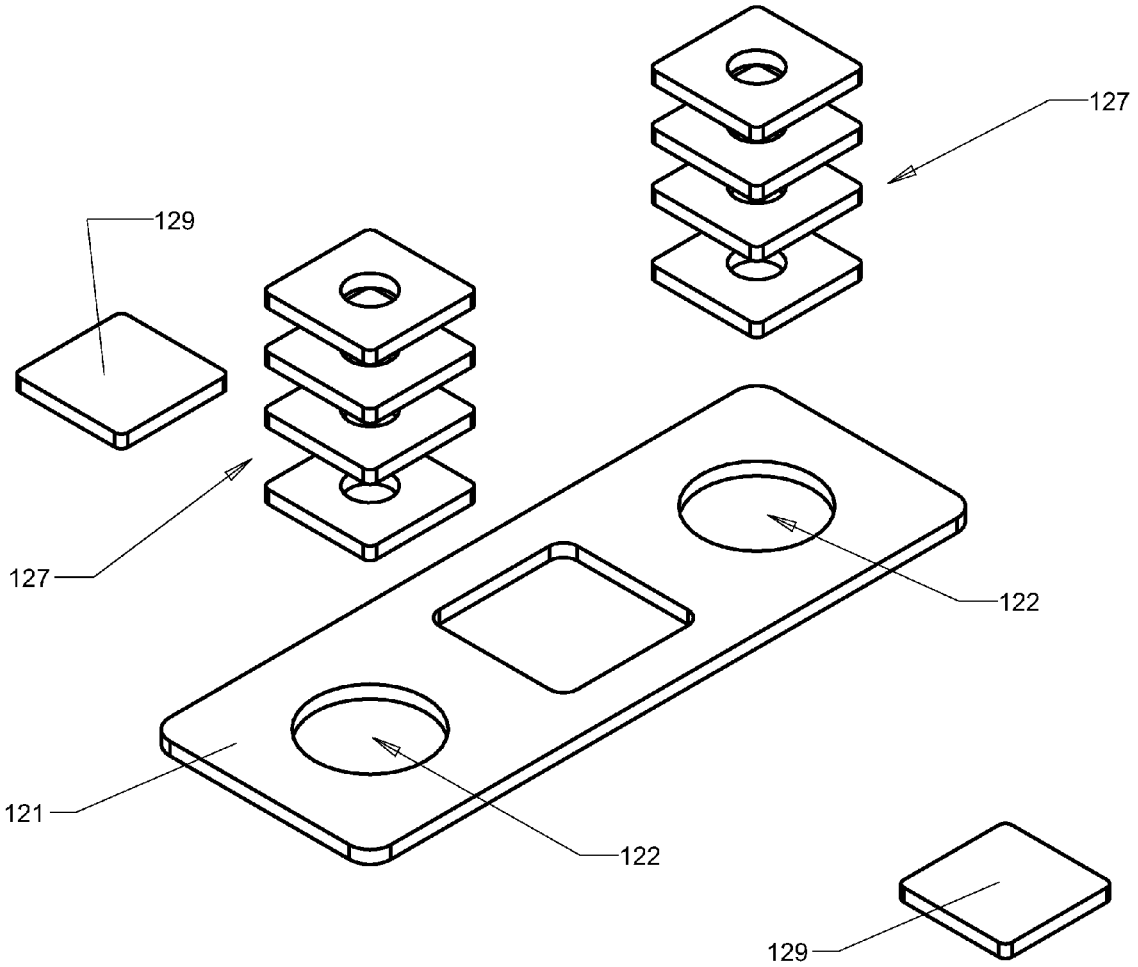
FIG. 2C illustrates an isolation block and two dampener blocks according to the principles of the present disclosure.

In some implementations, a dampener block 127 may be made from four stacked pieces of material (see, e.g., FIG. 2C). In some implementations, a dampener block 127 may be made from more than four or less than four stacked pieces of material. In some implementations, additional dampener blocks 127 may be used to secure the target plate assemblies 115 (discussed below) to the trunk tubes 160 (see, e.g., FIG. 3A).

In some implementations, the isolation blocks 121, isolation bars 123, and dampener blocks 127 may be made of an isolation material. In some implementations, the isolation material may be a vinyl solid sold under the name ISODAMP®. In some implementations, the isolation material may be any material suitable for the purposes discussed herein.

As shown in FIG. 2B, in some implementations, the isolation blocks 121, isolation bars 123, and dampener blocks 127 may be positioned and used to isolate each target plate 110 from the plate cross bar 117 and/or to isolate the plate cross bar 117 from each trunk tube 160. In this way, when a projectile strikes any portion of the electronically scored target array 100 the resulting forces (i.e., vibrations) are not transferred to a target plate 110 that was not directly struck by the projectile. This prevents the accelerometer 173 (discussed below) positioned on the back side of each target plate 110 from registering a hit when there was none (see, e.g., FIGS. 3A and 3B).

To assemble a target plate assembly 115 constructed in accordance with the present disclosure, in some implementations, an isolation block 121 is positioned against the backside of the target plate 110 so that the two screws 125 thereon are protruding from openings 122 in the isolation block 121 (see, e.g., FIG. 2A). The two screws 125 are then inserted through two openings 118 in the plate cross bar 117.

Next, one dampener block 127 is positioned against the backside of the plate crossbar 117 adjacent each of the two openings 118 therethrough so that a portion of a screw 125 is protruding from each dampener block 127 (see, e.g., FIG. 2B). Finally, a washer may be placed about a portion of each screw 125 and a threaded nut used to secure the target plate 110 to the plate cross bar 117 (see, e.g., FIG. 2B). This process may be repeated until all of the target plates 110 are attached to the plate cross bar 117.

In some implementations, the plate cross bar cap 119 may be secured to the plate cross bar 117 after all of the target plates 110 are attached thereto (see, e.g., FIG. 2B).

In some implementations, as shown in FIG. 2A, additional pieces 129 of isolation material may be positioned between each target plate 110 and the plate cross bar 117. In some implementations, the additional pieces 129 of isolation material may help to further isolate the target plates 110 from the plate cross bar 117. In some implementations, the additional pieces 129 of material may be secured in place through compression of the target plate 110 against the plate cross bar 117. In some implementations, the additional pieces 129 of material may be secured in place through the use of an adhesive.

To secure a target plate assembly 115 to the trunk tubes 160 constructed in accordance with the present disclosure, in some implementations, an isolation bar 123 may be initially positioned against the backside of each trunk tube 160 so that the two screws 166 extending from each trunk tube 160 are protruding from openings 124 in the isolation bar 123 (see, e.g., FIGS. 3A and 3B). The two screws 166 extending from each trunk tube 160 are then received within openings 116 in the plate cross bar 117 as the target plate assembly 115 is rested in place (see, e.g., FIG. 3B). Next, one dampener block 127 may be positioned against the backside of the plate crossbar 117 adjacent each of the two openings 116 therethrough so that a portion of a screw 166 is protruding from each dampener block 127 (see, e.g., FIG. 3B). Finally, a washer may be placed about a portion of each screw 166 and a threaded nut used to secure the target plate assembly 115 to the first and second trunk tubes 160A, 160B, respectively (see, e.g., FIG. 3A). This process may be repeated until all of the target plate assemblies 115 are attached to the trunk tubes 160 of the electronically scored target array 100.

As shown in FIG. 1A, in some implementations, the nine lasers 170 may be secured to the base 130 of the electronically scored target array 100. In some implementations, there may be one laser 170 for each target plate 110 on the electronically scored target array 100. In some implementations, each laser 170 is positioned so that a laser beam generated thereby illuminates a single target plate 110.

In some implementations, one or more lasers 170 may be used to designate one or more target plates 110 to be engaged by a shooter. In some implementations, each laser 170 may be positioned (e.g., angled) so that the laser beam generated thereby strikes somewhere on the top one-third of the target plate 110 strike face. In this way, a shooter may align their firearm's sights on a target plate 110 without obscuring their view of the laser beam striking the same target plate 110. In some implementations, each laser 170 may be positioned so that the laser beam generated thereby strikes anywhere on the target plate 110. In some implementations, there may be more than nine or less than nine lasers 170.

In some implementations, one or more of the lasers 170 may be configured to emit a green light. In some implementations, one or more of the lasers 170 may be configured to emit any visible color light (e.g., yellow, red, orange, green, etc.). In some implementations, one or more of the lasers 170 may be configured to emit an infrared light. In this way, a user having night vision equipment may be able to use the electronically scored target array 100 in the dark.

In some implementations, a light-emitting diode (LED) may be used in place of a laser 170. In some implementations, any illumination source suitable for illuminating a single target plate 110 at a time may be used in place of a laser 170.

As shown in FIGS. 1A and 1B, in some implementations, the lasers 170 may be positioned on a front side of the base 130 behind the base guard 140. In this way, the base guard 140 may protect the lasers 170 from being hit by a projectile (e.g., a bullet). In some implementations, the base guard 140 may include a horizontal lip 146 that extends from the strike face 142. In some implementations, the horizontal lip 146 of the base guard 140 may include six slots 144 therein (see, e.g., FIG. 1A). In some implementations, each slot 144 may be configured to allow a laser 170 aligned therewith to illuminate a designated target plate 110 (see, e.g., FIG. 1B). In some implementations, the front side of the base 130 may include three slots 134 therein (see, e.g., FIG. 1A). In some implementations, each slot 134 may be configured to allow a laser 170 aligned therewith to illuminate a single target plate 110 (see, e.g., FIG. 1B). In some implementations, the total number of slots 134 in the front side of the base 130 in combination with the total number of slots 144 in the base guard 140 may be equal to the total number of lasers 170. In some implementations, the slots 134 in the front side of the base 130 and the slots 144 in the base guard 140 may be configured and positioned to protect the lasers 170 from spall resulting from a projectile striking a portion of the electronically scored target array 100.

Figure 4A:
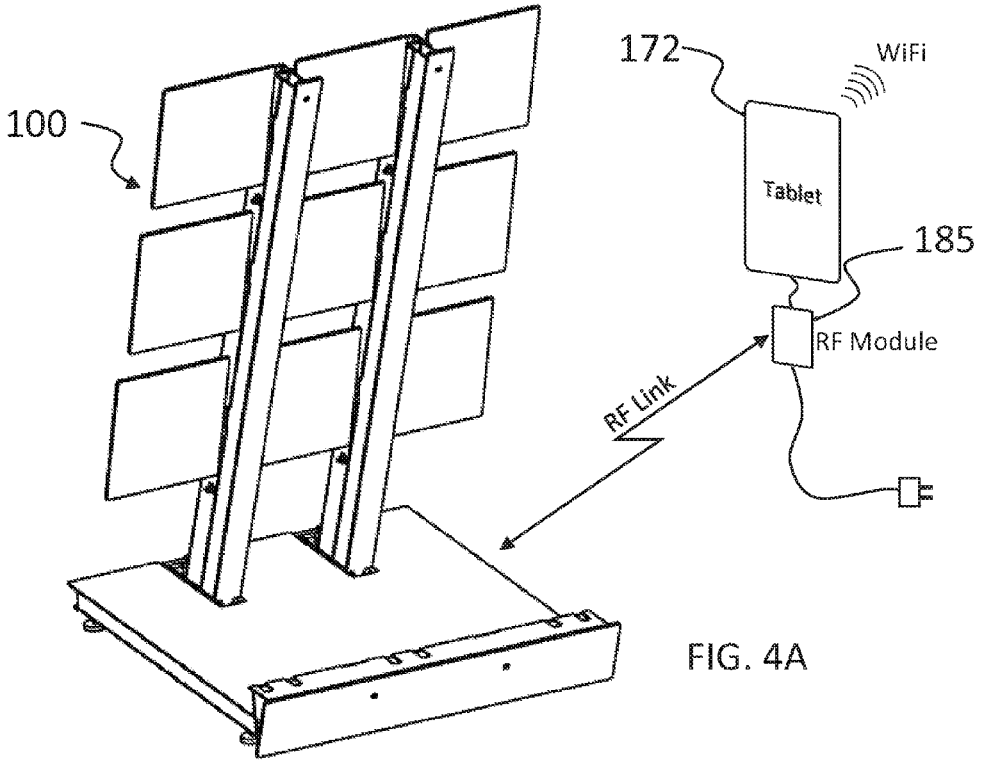
FIGS. 4A and 4B illustrate a target controller and a computer that may be used to operate the electronically scored target array.
Figure 4B:
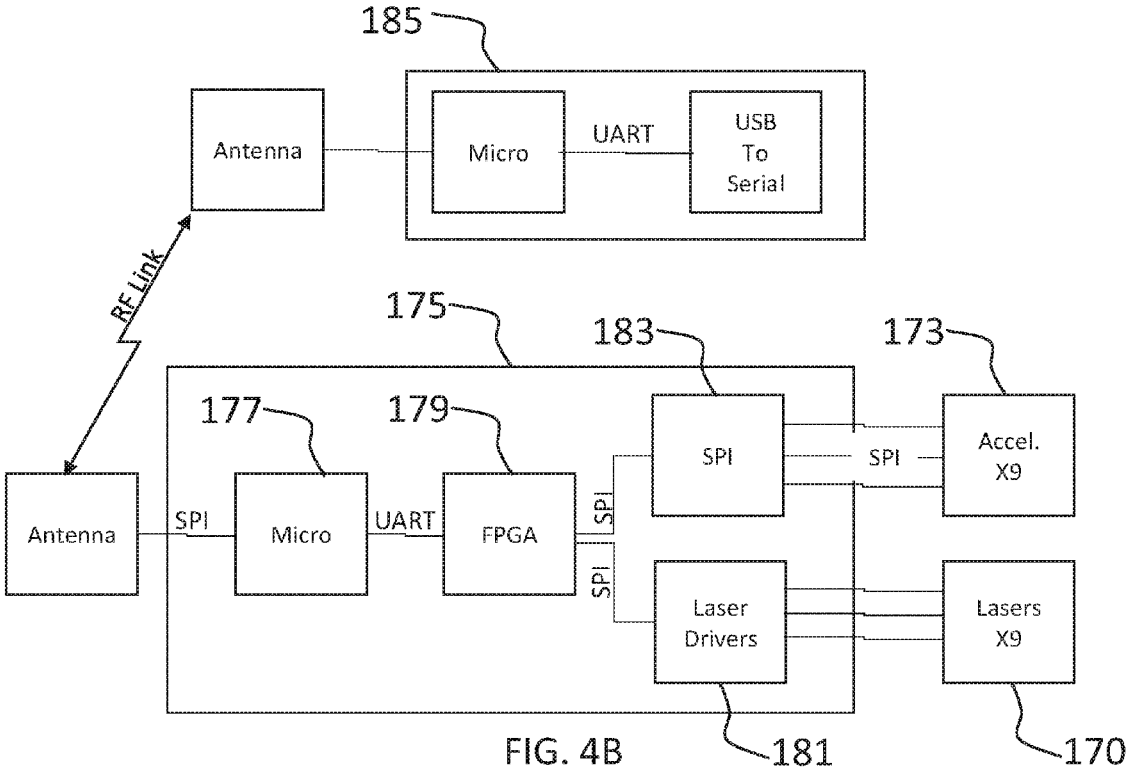

As shown in FIGS. 4A and 4B, in some implementations, a target controller 175 in conjunction with a computer 172 (e.g., a laptop, desktop, tablet, and/or other portable electronic device) may be used to control the operation of the lasers 170 and/or the accelerometers 173 of the electronically scored target array 100. While not shown, it should be understood that suitable wiring connects the lasers 170 and accelerometers 173 to the target controller 175. In some implementations, the target controller 175 may be equipped with an antenna configured to facilitate remote communication between the target controller 175 and an RF (radio frequency) module 185 operably connected to a computer 172 (see, e.g., FIG. 4A). In some implementations, one to nine target controllers 175 may be operated by a single computer 172.

In some implementations, as shown in FIG. 4B, the target controller 175 may be comprised of a microprocessor 177, a field-programmable gate array (FPGA) 179, laser drivers 181, and a transceiver 183. One of ordinary skill in the art having the benefit of the present disclosure would know how to create a target controller 175.

In some implementations, the transceiver 183 may be configured to communicate with the one or more accelerometers 173 used with each target plate 110. In some implementations, when an accelerometer 173 on a target plate 110 registers the impact of a projectile on that target plate, a signal is passed through the transceiver 183 to the target controller 175. In some implementations, the target controller 175 may be configured to control when, for how long, and/or which accelerometer(s) 173 are activated. In this way, only hits on a target plate 110 with an activated accelerometer 173 are recorded.

In some implementations, the laser drivers 181 may be configured to communicate with the lasers 170 used to designate the target plates 110. A signal may be passed from the target controller 175 through the laser drivers 181 to the lasers 170 and thereby control when, for how long, and/or which laser(s) 170 are activated. In this way, a user may know which target plates 110 to engage (i.e., to shoot) for score.

In some implementations, gaming software 300 may be used in conjunction with a computer 172 and one or more target controllers 175. In some implementations, the gaming software 300 may be used to control the activation of the lasers 170 and/or accelerometers 173. In some implementations, the gaming software 300 may be used to create a preset course of fire that will control the activation of the lasers and/or accelerometers (173).

In some implementations, the gaming software 300 may be used to create a course of fire in which one or more target plates 110 are designated (i.e., illuminated) by a laser 170 in a preset order for a preset amount of time. In some implementations, the laser 170 and the accelerometer 173 of the designated target plate 110 may only be active for the preset amount of time.

In some implementations, the laser 170 and the accelerometer 173 of the designated target plate 110 may remain active until the shooter successfully engages the designated target plate. In some implementations, after the designated target plate 110 has been shot and a preset amount of time has passed (i.e. a delay), the accelerometer 173 of another target plate 110 may then be activated and the target plate 110 designated by its associated laser 170. In some implementations, after the designated target plate 110 has been shot, the accelerometer 173 of another target plate 110 may be immediately activated (i.e. no delay) and the target plate 110 designated by its associated laser 170.

In some implementations, for example, all of the target plates 110 may be simultaneously designated by a laser 170 and their respective accelerometers 173 activated. As the shooter successfully engages each target plate 110, the laser 170 designating that target plate 110 turns off as does its accelerometer 173. In this way, the shooter will be provided with a visual indication as to which target plates 110 have been successfully engaged (i.e. there is no laser visible on those target plates 110) and those that have not (i.e. the laser is still visible on those target plates 110). In some implementations, the time between the activation of each laser 170 and accelerometer 173 and when a shooter successfully engages each target plate 110 may be recorded.

In some implementations, the course of fire may be randomly generated by the gaming software 300 on demand.

In some implementations, the gaming software 300 may be used to record the amount of time that passes from the initial designation of a target plate 110 by a laser 170 and a shooter successfully shooting (i.e. hitting with a projectile) the target plate.

In some implementations, when a target plate 110 being designated by a laser 170 is shot its accelerometer 173 may register the hit and the gaming software 300 may record the hit for the purposes of scoring. In some implementations, the accelerometer 173 of a target plate 110 may only be active while a laser 170 is illuminating that target plate 110. In this way, the gaming software 300 only records hits on target plates 110 to which the shooter is being directed by the lasers 170.

In some implementations, the gaming software 300 may associate recorded times, successful hits on the target plates 110, the number of target plates 110 not hit (i.e., missed), and/or any other recorded information with a particular shooter. In some implementations, the recorded times, successful hits on the target plates 110, the number of target plates 110 not hit, and/or any other recorded information may be stored by the gaming software 300 in nonvolatile memory and associated with an account of the shooter's.

In some implementations, the gaming software 300 may be connected via a network to a web server. In this way, a shooter's account may be retrieved by the gaming software 300 and/or the gaming software 300 may associate information recorded during a course of fire with the shooter's account.

In some implementations, an administrator of the gaming software 300 can interact with the web server via an application, such as a web browser or a native application, residing on a computer 172. In some implementations, the recorded times, successful hits on the target plates 110, the number of target plates 110 not hit, and/or any other recorded information (e.g., personal information about the shooter) may be stored in a database by the gaming software 300.

In some implementations, the communication of data and data processing may be performed in real time or non-real time by the gaming software 300.

One of ordinary skill in the art, having the benefit of the present disclosure, could produce the gaming software 300 described herein.

In some implementations, the base 130, base guard 140, cover plate 150, target plates 110, trunk tubes 160, and/or strike plates 162 may be manufactured from a steel and/or other metal alloy. In some implementations, the base 130, base guard 140, cover plate 150, target plates 110, trunk tubes 160, and/or strike plates 162 may be manufactured from any material suitable for resisting repeated impacts by projectiles discharged from a firearm.

It is to be understood that, in some implementations, the electronically scored target array 100 could be used simply as a target array by omitting, for example, the target controller 175, lasers 170, accelerometers 173 and/or other related electrical components.

While the various implementations of the electronically scored target array 100 disclosed herein are intended to be used with a firearm (e.g., a rifle and/or handgun), in some implementations, the electronically scored target array 100 may be configured to work with alternative projectile launchers (e.g., BB guns, pellet guns, airsoft guns, etc.). In implementations configured to be used with these alternative projectile launchers, the base 130, base guard 140, cover plate 150, target plates 110, trunk tubes 160, and/or strike plates 162 may be manufactured from a polymer material.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. An electronically scored target array, the target array comprising:

a base having at least one interior compartment, and a first trunk tube and a second trunk tube secured thereto, the first trunk tube and the second trunk tube extend from the base at a first angle relative to the base;

at least one target plate assembly configured to be supported by the first trunk tube and the second trunk tube, the at least one target plate assembly comprises three target plates positioned thereon so that a front side of each target plate is at a second angle relative to the base;

a cover plate configured to fit onto a top side of the base and thereby cover the at least one interior compartment of the base;

a base guard secured to a front side of the base, the base guard is configured to protect the base and the at least one interior compartment of the base;

an accelerometer secured to a backside of each target plate, each accelerometer is configured to register only the impact of a projectile on the front side of the target plate to which the accelerometer is secured;

at least three lasers secured to the base, each laser is configured to illuminate a different target plate on the at least one target plate assembly; and a target controller positioned within the at least one interior compartment of the base, the target controller is configured to communicate with and control the operation of each accelerometer and the at least three lasers;

wherein the first angle of the first trunk tube and the second trunk tube relative to the base is different than the second angle of the front side of each target plate relative to the base.

2. The target array of claim 1, wherein the at least one target plate assembly further comprises a plate cross bar to which the target plates are secured, and isolation material positioned between each target plate and the plate cross bar thereby preventing forces resulting from a projectile striking one target plate from being transferred to another target plate that was not directly struck by the projectile.

3. The target array of claim 2, wherein the at least one target plate assembly further comprises additional isolation material positioned between the plate cross bar and the first trunk tube and the second trunk tube to which it is secured.

4. The target array of claim 3, wherein the isolation material is a vinyl solid.

5. The target array of claim 1, comprises three target plate assemblies configured to be supported by the first trunk tube and the second trunk tube of the base, and nine lasers secured to the base.

6. The target array of claim 1, further comprising a first strike plate secured to a first side of the first trunk tube and a second strike plate secured to a first side of the second trunk tube, the first strike plate and the second strike plate are configured to protect the first trunk tube and the second trunk tube from impacting projectiles.

7. The target array of claim 6, wherein the first strike plate is wider than the first trunk tube and the second strike plate is wider than the second trunk tube.

8. The target array of claim 1, further comprising a first spall plate secured to a first side of the target array and a second spall plate secured to a second side of the target array, the first spall plate and the second spall plate are configured to prevent projectile spall from striking objects located to either side of the target array.

9. The target array of claim 8, wherein the first spall plate and the second spall plate each comprise a first side wall and a second side wall, the second side wall is at a perpendicular angle relative to the first side wall of each spall plate.

10. The target array of claim 1, wherein the first angle of the first trunk tube and the second trunk tube relative to the base is less than the second angle of the front side of each target plate relative to the base.

11. The target array of claim 1, wherein the base guard comprises an angled strike face having a horizontal lip extending from a back side thereof, wherein the horizontal lip of the base guard is configured to protect the at least three lasers secured to the base.

12. The target array of claim 1, wherein each of the at least three lasers secured to the base are angled so that the laser beam generated thereby strikes somewhere on the top one-third of the front side of the target plate.

13. The target array of claim 1, wherein each of the at least three lasers secured to the base are configured to emit an infrared light.

14. The target array of claim 1, wherein the target controller comprises a microprocessor, a field-programmable gate array, laser drivers configured to communicate with the at least three lasers, and a transceiver configured to communicate with the accelerometer secured to each target plate.

15. The target array of claim 14, wherein the target controller further comprises an antenna configured to facilitate remote communication between the target controller and an RF module operably connected to a computer.

16. The target array of claim 14, further comprising gaming software for use on a computer, the gaming software is configured to control the activation of the at least three lasers and each accelerometer through the target controller, and the gaming software is configured to provide a course of fire that will control the activation of the at least three lasers and each accelerometer.

17. The target array of claim 16, wherein the gaming software is configured to store information recorded during a course of fire.

18. The target array of claim 1, wherein the base, the base guard, the cover plate, the target plates, the first trunk tube, and the second trunk tube are manufactured from a steel alloy.

19. The target array of claim 1, wherein the base, the base guard, the cover plate, the target plates, the first trunk tube, and the second trunk tube are manufactured from a polymer.

* * * * *